US005616085A

United States Patent [19]

LaCoste, Jr. et al.

[11] Patent Number: 5,616,085

[45] Date of Patent: Apr. 1, 1997

[54] GOLF SWING TRAINING DEVICE

[76] Inventors: James P. LaCoste, Jr., 103 Fontaine Dr., Greenville, S.C. 29607; Joseph M. Ramseur, 18 Crescent Ave., Greenville, S.C. 29605

[21] Appl. No.: 638,727

[22] Filed: Apr. 29, 1996

[51] Int. Cl.[6] ..... A63B 69/36

[52] U.S. Cl. ..... 473/267; 473/271; 473/272; 473/273

[58] Field of Search ..... 473/218, 271, 473/272, 273, 267, 266

[56] References Cited

U.S. PATENT DOCUMENTS

| | | | |
|---|---|---|---|
| 1,517,555 | 12/1924 | Graham | 473/273 X |
| 3,658,344 | 4/1972 | Kimble | 473/272 |
| 4,257,608 | 3/1981 | Funk | 473/272 |
| 4,545,581 | 10/1985 | Williamson | 473/270 |
| 4,651,994 | 3/1987 | Lee | 473/271 |
| 4,784,393 | 11/1988 | Williams et al. | 473/272 |
| 4,817,953 | 4/1989 | Ponchak | 473/271 |
| 4,925,192 | 5/1990 | Forbes | 473/273 |
| 5,362,060 | 11/1994 | Hinson | 473/272 X |

*Primary Examiner*—George J. Marlo
*Attorney, Agent, or Firm*—Gerald R. Boss; Cort Flint

[57] ABSTRACT

A golf swing training aid for a golfer having an elongated stance positioning member and a plurality of discrete placement indicators having a size generally equal to the size of a standard golf ball extending along the general length of the stance positioning member. A golf ball positioner carried by the stance positioner member extends generally perpendicularly away from the stance positioning member when positioned at a respective placement indicator for positioning a golf ball at a prescribed location within the golf stance of the golfer. The discrete placement indicators assist the golfer in ascertaining the correct heel placement for properly positioning the golf ball within his or her stance relative to the positioning of the golf ball positioner.

28 Claims, 5 Drawing Sheets

GOLF SWING TRAINING DEVICE

BACKGROUND OF THE INVENTION

This invention relates to a golf swing training device, and more particularly, to a golf swing training device that may quickly and easily be positioned in a consistent repeated manner for assisting the golfer in positioning his or her feet relative to a golf ball depending on the type of golf club being used.

In the game of golf, the positioning of a golf ball correctly within the stance of a golfer is critical for proper contact. However, depending on the size of the golfer and the idiosyncracies of the golfer's swing, the particular placement of a golf ball within the golfer's stance will vary between golfers. Accordingly, much practice is required for the golfer to find the appropriate positioning of the golf ball within his or her respective stance. Furthermore, positioning of the golfer's stance with respect to the target line, which is the line of flight which the ball is aimed, is also critical.

Golf training devices have been invented for assisting the golfer in placing his or her feet with respect to a golf ball and in alignment with a target line. While these devices are suitable for their intended purpose, they use sliding components which are complicated to use and may not consistently place the golfer's feet at the correct position during repeated usage. Furthermore, the sliding components may be knocked out of place should the golf club strike the training device which is a common occurrence when practicing.

U.S. Pat. No. 4,257,608 discloses a lateral scale strip having a pair of foot-aligning strips. One of the foot aligning strips is pivotally secured near one end of the lateral scale strip and the other foot-aligning strip is slidably and pivotally mounted to an opposite end. A perpendicular scale strip having a width which covers the lateral scale is slidably mounted with respect to the lateral scale strip for positioning the golf ball. A short club-swing aligning strip may be pivotally attached to one end of the perpendicular scale strip. Since the perpendicular scale is slidably mounted with respect to the lateral scale, displacement of the perpendicular scale occurs when the golfer's club inadvertently strikes the perpendicular scale. Furthermore, consistent positioning of the sliding scale along the lateral scale strip is difficult.

U.S. Pat. No. 4,784,393 discloses a golf training device having a second body member for positioning a golf ball which is attached to a first body member which has a right and left foot positioner. The second body member is slotted allowing variable longitudinal positioning but does not provide for variable lateral positioning of the golf ball within the golfer's stance.

These golf aids are designed to be placed between the golfer and the golf ball. In doing so, these devices operate by aligning the toe of the golfer and not the heel, should the golfer turn his or her feet, the ball will be misaligned within the golfer's stance. Also, while these golf training devices assist golfers for swinging irons, woods and drivers, they are not designed to assist the golfer in putting or assist the golfer in positioning his or her weight. Furthermore, they do not deter swaying by the golfer during the swing.

Accordingly, it is an object of the present invention to provide a golf swing training device which can consistently position a golf ball within a golfer's stance depending on the golfer's preference;

Also, it is an object of the present invention to provide a golf swing training device which can be used for irons and woods and putting;

Furthermore, it is an object of the present invention to provide a golf swing training device which can consistently position a golfer's heel relative to a golf ball for positioning the golf ball accurately within the golfer's stance;

Also, it is an object of the present invention to provide a golf swing training device which assists the golfer for positioning his or her weight on the inside of the back foot and from swaying the hips during the take away and follow through of the swing.

SUMMARY OF THE INVENTION

The above objectives are accomplished according to the present invention by providing a golf swing training device for a golfer having an elongated stance positioning member generally exceeding the length of a golfer's stance for assisting a golfer in positioning the golfer's feet for striking a golf ball. The stance positioning member includes a top surface and a base extending along a general length for assisting the golfer in positioning the golfer's feet. A plurality of discrete placement indicators spaced along said top surface of the stance positioning member for indicating the positioning of a golf ball. The placement indicators have a width generally equal to the size of a standard golf ball which extend along the general length of the stance positioning member. A golf ball positioner is attached to the stance positioning member generally perpendicularly away from the stance positioning member when positioned at a respective placement indicator position for positioning a golf ball at a prescribed location within the golf stance of the golfer.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
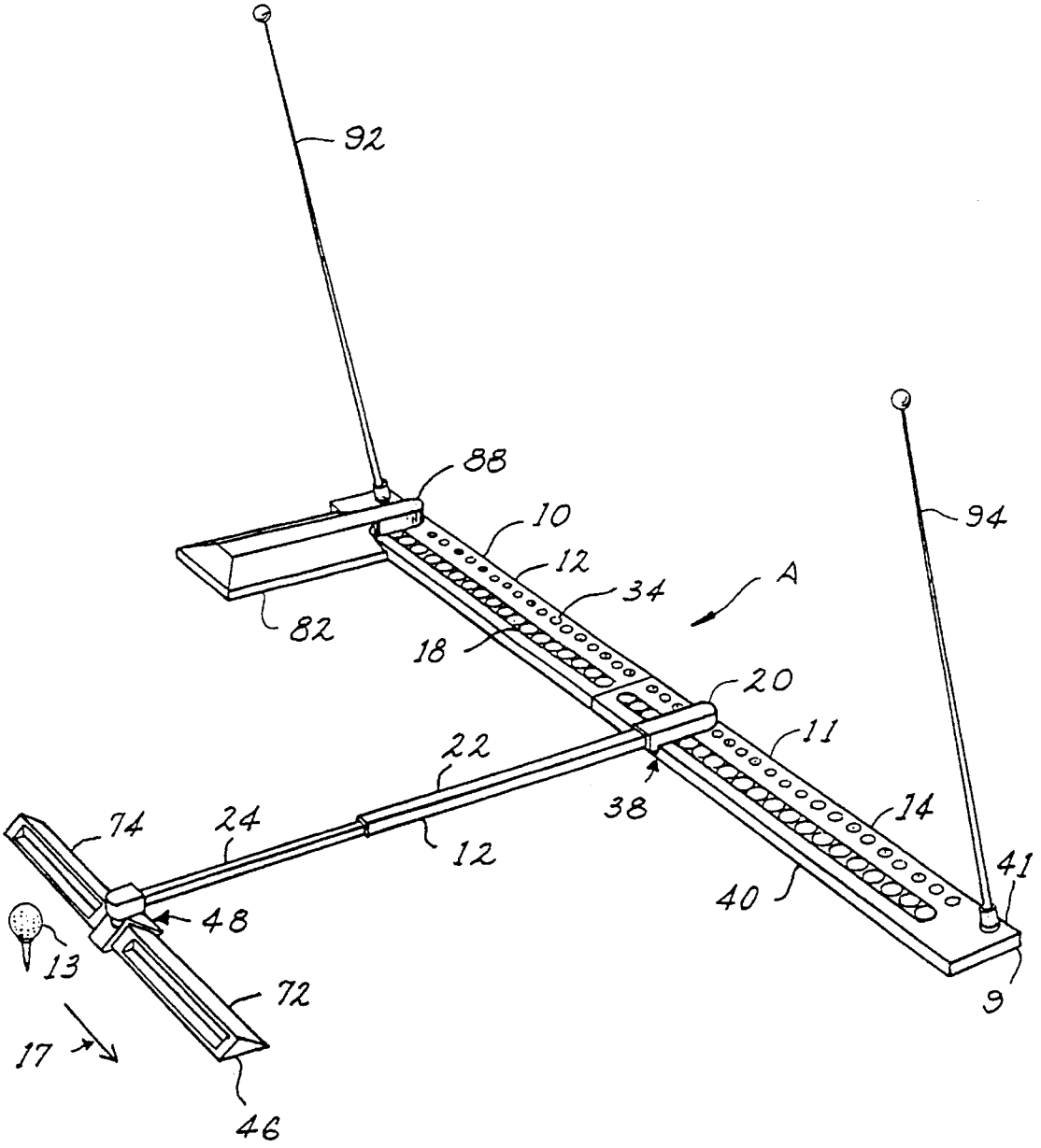
FIG. 1 illustrates a golf swing training device according to the invention.

Referring now in more detail to the drawings, the invention will now be described in more detail. FIG. 1 illustrates a golf swing training device A which includes stance positioning member 10 for guiding the placement of the golfer's feet and a golf ball positioner 12 for positioning golf ball 13 within the golfer's stance.

Figure 2:
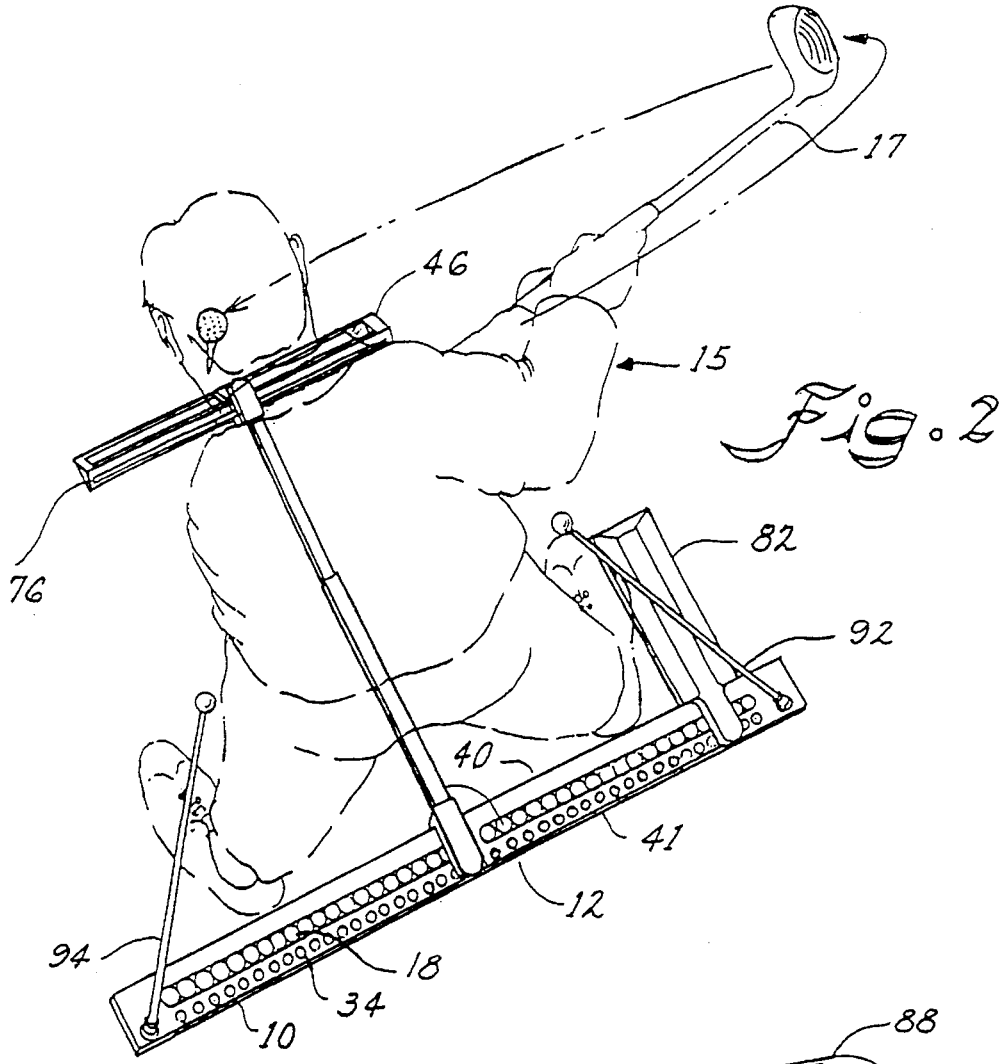
FIG. 2 illustrates a golfer utilizing a golf swing training device according to the invention.
Figure 7:
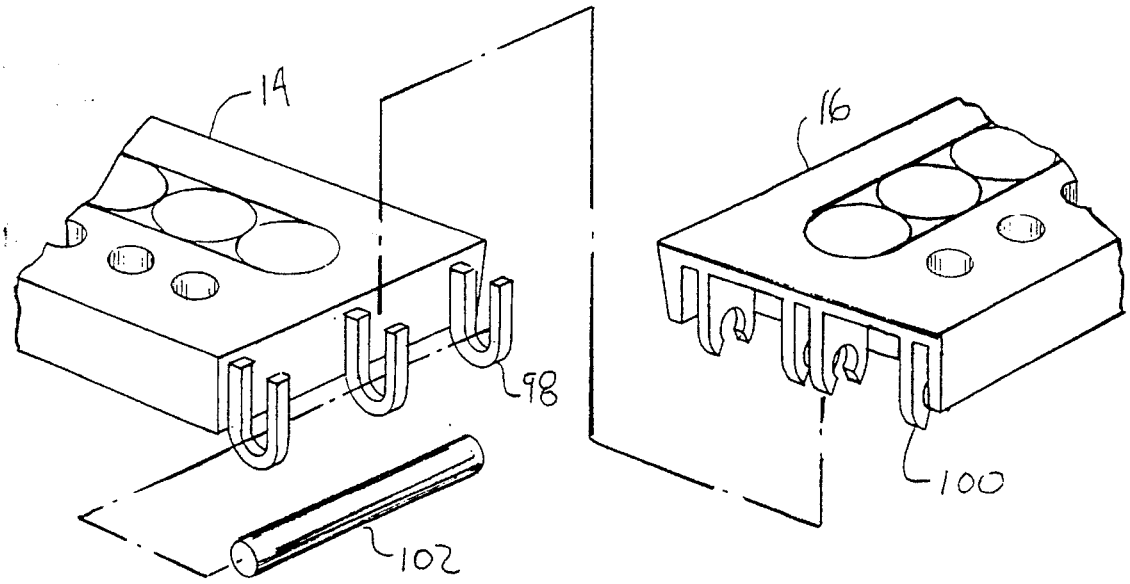
FIG. 7 illustrates the stance positioning member of a golf swing training device having two separate interlocking components according to the invention.

As shown in FIGS. 1, 2 and 7 stance positioning member 10 is elongated and approximately forty inches in length generally exceeding the length of a golfer's stance. Stance positioning member 10 includes top surface 11 and base 9. In the preferred construction, stance positioning member 10 is molded from plastic. Stance positioning member 10 includes first base bar 14 and second base bar 1 which interlock to form a unitary piece. The two piece construction will provide for a compact unit which may easily be broken down and transported within a conventional golf bag.

A plurality of fixed placement indicators 18 are permanently positioned along the top surface 11 of stance positioning member 10 abutting each other for indicating the placement of the golf ball within the golfer's stance while golfer 15 swings golf club 17. Fixed placement indicators 18 are generally the size of a standard golf ball which range generally from approximately one point six inches to one point six eight inches in diameter and in the preferred embodiment replicate the general circular shape and size of a golf ball.

As shown in FIGS. 1 and 2, stance positioning member 10 includes front face 40 and back face 41. It is intended that fixed placement indicators 18 are aligned with the heel of the golfer. Accordingly, in the preferred embodiment, fixed placement indicators 18 are positioned near front face 40 enabling golfer 15 to quickly ascertain the correct placement of the golf ball within the golfer's stance relative to the heel position of either the front or back foot.

The permanent placement of fixed placement indicators 18 is important in assisting the golfer to easily ascertain the desired positioning of the golf ball within the golfer's stance. Many golf instructors advocate the proper placement of a golf ball within a golfer's stance based upon reference to the width of a golf ball from the golfer's front or back heel. For instance, if the golfer prefers to place the golf ball two golf ball widths off the front foot for a long iron shot, the golfer can quickly and consistently ascertain a distance of two golf ball widths away from the heel of the front foot by reference to the corresponding fixed placement indicator 18. Should the golfer switch clubs such as a short iron and the golf instructor instructs the golfer to position the golf ball three golf ball widths from the heel of the front foot, the golfer can quickly and easily reposition the heel of the golfer's front foot relative to golf ball positioner 12 with certainty.

Figure 5:
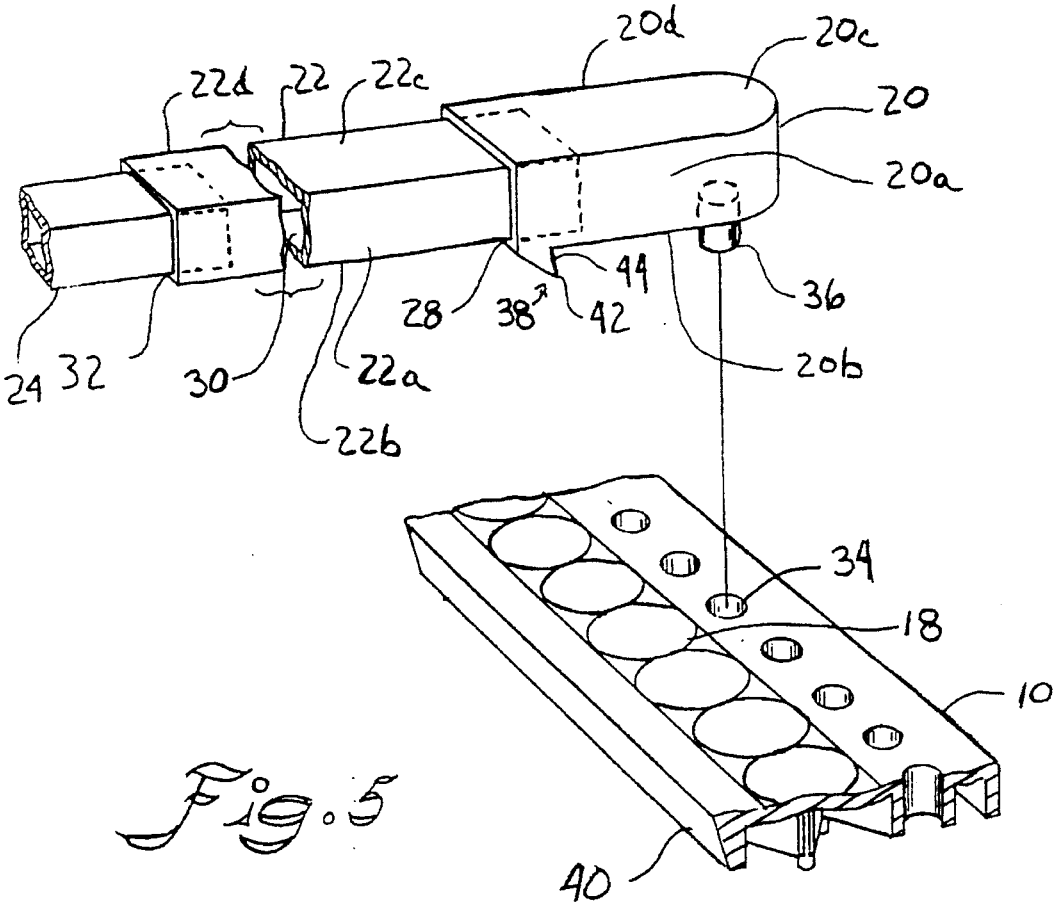
FIG. 5 illustrates a golf ball positioner with a section cut away for attachment to a golf swing training device according to the invention.

As shown in FIGS. 1 and 2, golf ball positioner 12 extends perpendicularly away from stance positioning member 10 for positioning the golf ball away from golfer 15 and along target line 17. Golf ball positioner 12 is telescopic and includes first arm 22 and second arm 24. As shown in FIGS. 1, 2 and 5, attachment housing 20 attaches first arm 22 to stance positioning member 10. Attachment housing 20 includes sides 20*a*–20*d* defining housing interior 26 which communicates with attachment arm opening 28 for receiving first arm 22. First arm 22 includes four sides 22*a*–22*d* defining first arm interior 30 which communicates with first arm opening 32. Second arm 24 is smaller than first arm 22 and is slidably received within first arm interior 32 enabling golf ball positioner 12 to be telescopic. By being telescopic, golf ball 13 may be positioned at a desired location away from the golfer. First arm 22 is preferably eighteen inches in length and second arm 24 is preferably fourteen inches in length providing for a variable length of golf ball positioner of eighteen to thirty-two inches.

As shown in FIGS. 1, 2, 3, 4, and 5, a plurality of receptacles 34 are defined along the length of stance positioning member 10 behind fixed placement indicators 18 near the back face of stance positioning member 10. Receptacles 34 provide discrete locations for attaching attachment housing 20 to stance positioning member 10. Receptacles 34 are predominately aligned with the center of each fixed placement locator so that as shown in FIG. 2, attachment housing 20 covers a respective fixed placement locator for defining an orientation point from which the golfer can ascertain the positioning of his or her heels relative to golf ball position indicator 12.

Figure 4:
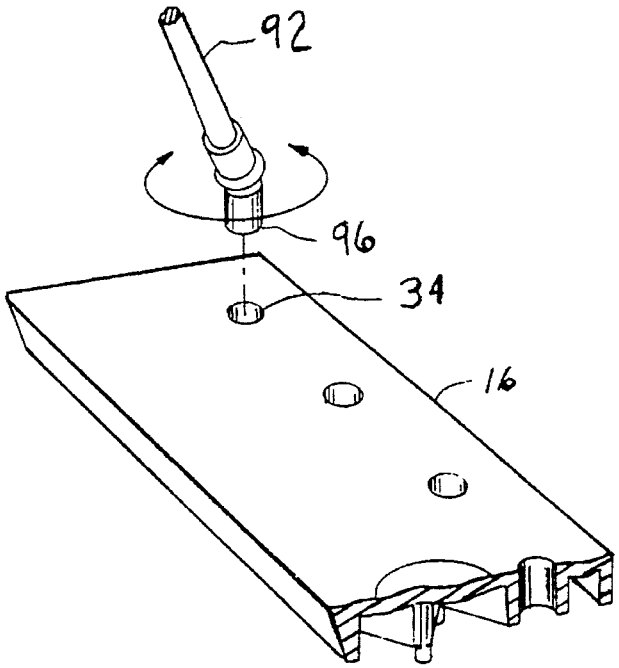
FIG. 4 illustrates a sway guide for attachment to a golf swing training device according to the invention.

As shown in FIG. 4, attachment housing 20 includes stem 36 which is of a suitable size for placement within a respective receptacle 34. By utilizing stem 36, golf ball positioner 12 may be easily positioned at a specific location within the golfer's stance and repositioned for different clubs or the golfer may vary his stance with the respect to golf ball positioner 12. By providing discrete locations for golf ball positioner 12 to be located, the golfer can accurately position golf ball positioner 12 in place repeatedly during training. Such placement eliminates guesswork by the golfer as to the exact displacement of the golf ball within the golfer's stance. The golfer merely needs to remember for each particular club how many golf ball width's the ball should be within the golfer's stance.

As shown in FIG. 5, attachment housing 20 includes locking mechanism 38 which in combination with stem 36 being placed within a respective receptacle 34 locks golf ball positioner 12 into place. Stance positioning member 10 includes a slightly beveled face 40. Locking mechanism 38 includes a finger 42 forming a flange depending downward from attachment housing 20. Finger 42 includes an abutment face 44. When positioning golf ball positioner 12, abutment face 44 abuts beveled face 40 of stance positioning member 10 and finger 42 snaps under the bottom of stance positioning member 10 which in conjunction with stem 36 locks golf ball positioner 12 in place. Locking mechanism 38 enables golf ball positioner 12 to remain in position while the golfer practices his or her swing even if the golfer should inadvertently strike golf ball positioner 12 or other components of swing aid device A.

Figure 6:
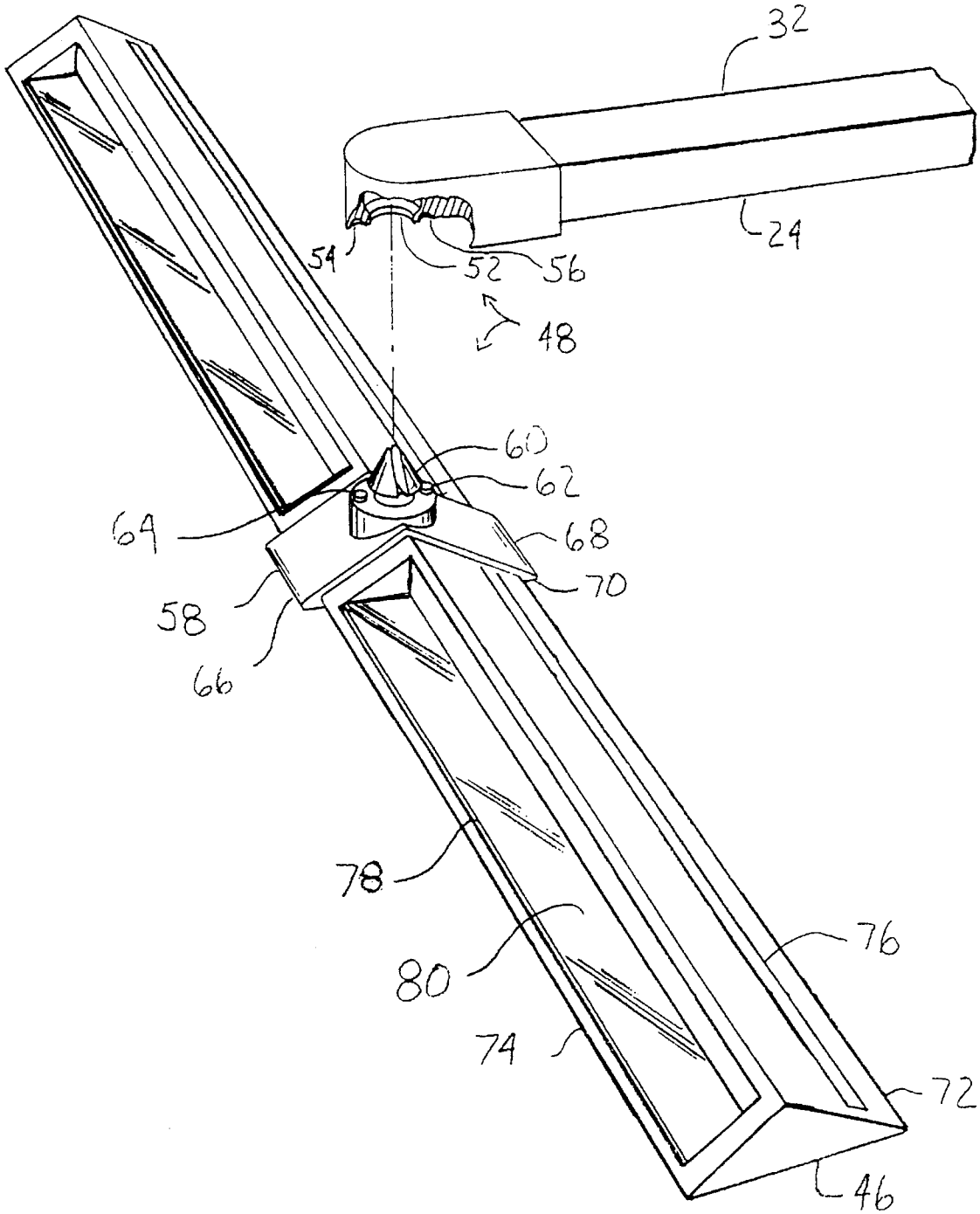
FIG. 6 illustrates a golf swing guide for attachment to a golf ball positioner arm according to the invention.

As shown in FIGS. 1, 2 and 6, swing aid guide 46 is parallel to the intended flight path of golf ball 13. Swing aid guide 46 is pivotally and slidably carried by second arm 24 of golf ball positioner 12 by swing aid mount 48. Swing aid guide 46 is preferably twelve inches in length and guides the golfer in taking the golf club backwards during the take away from the golf ball and during the following through. Since different golfer's will have different take away and follow through lengths, swing aid guide 46 is slidably mounted with respect to swing aid arm carrier so that a desired length of swing aid guide 46 is located on either side of golf ball positioner 12.

As shown in FIG. 6, swing arm mount 48 includes golf ball positioner's second arm 24 defining socket 52, first boss 54 receptacle and second boss receptacle 56. Swing arm mount 48 also includes swing arm carrier 58. Swing arm carrier 58 includes ball 60 which is pivotally received within socket 50 and first boss 62 and second boss 64 which are received within either first or second boss receptacle 54 or 56 for locking swing arm carrier 58 in either a first or second position parallel to stance positioning member 10. Swing arm carrier 58 includes sides 66, 68 and 70 which define swing arm chamber 72 which slidably receives swing aid guide 46. By being slidably mounted, a predominate portion of swing aid guide 46 may be positioned on either side of golf ball positioner 12 to assist the golfer during the take away portion of the swing or follow through.

As shown in FIGS. 1 and 6 in the preferred embodiment, swing aid guide 46 is triangular. Swing aid guide 46 has a first swing guide side 72 and second swing guide side 74. Swing aid indicia 76 which is preferably a stripe is positioned along first swing guide side 72 providing a visual guide to the golfer in taking the club back or forward. Since a golfer is looking at the ball with the head bent downward, the triangular profile enables swing aid indicia 76 to be easily visible to the golfer. Second swing guide side 74 is indented forming ledge 78. Ledge 78 carries mirrored indicia 80 along its length. Mirrored indicia 80 is used for putting training and is rotated to face the golfer. It is taught that when putting, the golfer should stand over the ball. Accordingly, the mirrored surface enables the golfer to see his or her reflection indicating correct positioning. Furthermore, swing aid guide 46 guides the golfer in taking the putter straight back and straight forward.

In operation, swing aid guide 46 is pivoted to a first position until boss 64 engages second boss receptacle 54 whereby the stripe indicia is positioned facing the golfer for guiding swings of irons, woods and driver. For putting, swing aid guide is pivoted to a second position at which boss 64 is received within first boss receptacle 52 whereby the mirrored surface is positioned facing the golfer for guiding putting strokes. Of course, the golfer may prefer not to rotate swing aid guide 46.

During the course of training, it is expected that the golfer will accidently strike either swing aid guide 46 or golf ball positioner 12. Accordingly, by locking swing arm guide 46 and golf ball positioner 12 in place, the golfer is not required to constantly realign the training device so that golf swing guide 46 is parallel to stance positioning member 10 or the particular location of golf ball positioner 12 within the golfer's stance. Such a construction is conducive to repeated swinging by the golfer during practicing and provides for constant placement of the golf ball within the golfer's stance.

Figure 3:
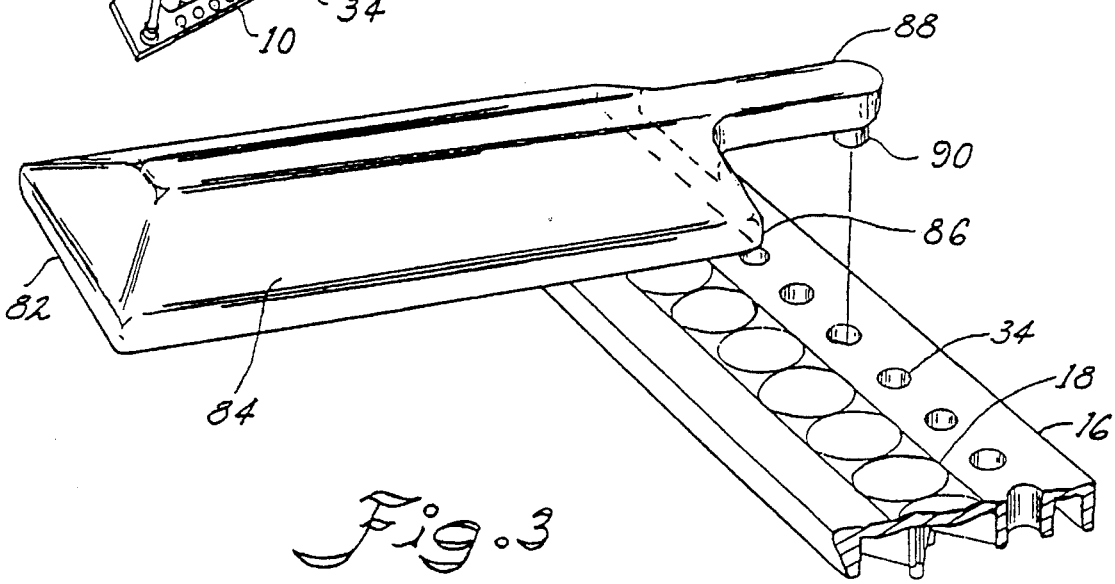
FIG. 3 illustrates a foot support for attachment to a golf swing training device according to the invention.

As shown in FIGS. 1, 2 and 3, foot support 82 assists the golfer in placing the golfer's weight forward within the golfer's stance. Foot support 82 is wedge-shaped having incline face 84 and base abutting face 86. Foot support 84 includes extension 88 and foot support stem 90 depending downward for placement in a designated receptacle 34 of stance positioning member 10. Extension 88 is of a sufficient length to traverse stance positioning member 10 enabling base abutting face 86 to abut the front face of stance positioning member 10 when foot support stem 90 is placed within a respective receptacle 34. Foot support 82 may be positioned at a desired location along stance positioning member 10 depending on the width of the golfer's stance.

As shown in FIGS. 1, 2 and 4 sway restraints 92 and 94 are carried by stance positioning member 10 to restrain the golfer from swaying either during the back swing or follow through. A common problem with golfer's is that they will sway their hips moving their center of gravity away from the ball. Sway restraints 92 and 94 extend upward from stance positioning member 10 from a respective receptacle 34 a height sufficient for the golfer to detect should he or she sway. In the preferred embodiment this height is approximately twenty-four inches in height. The ends 96 of sway restraints 92 and 94 are of a sufficient size to fit within a respective receptacle 34 of stance positioning member 10. In this manner, sway restraints may be positioned at any desired location by the golfer depending on their stance with respect to the golf ball. In the preferred embodiment, golf swing training device is intended to be positioned behind the golfer. Accordingly, ends 96 of sway restraints 92 and 94 are angled so that they may contact the golfer's leg providing positive pressure against the golfer hindering the golfer from swaying.

As shown in FIG. 7, first base bar 14 includes a first plurality of upwardly opened U-shaped clamps 98 and second base bar 16 includes a second plurality of downwardly opened U-shaped clamps 100 which interrelated with one another to form a support channel. Rod 102 is positioned within the support channel thereby maintaining first base bar 14 and second base bar 16 together to form stance positioning member 10.

Thus, it can be seen that an advantageous construction can be had for a golf swing training device according to the invention where the golf ball may readily be positioned within a golfer's stance by easily and repeatedly locating a golf ball positioner along a stance positioning member. By providing discrete placement locations a point of reference may easily be ascertained and the golfer may accurately position his or her feet relative to the golf ball positioner. By locking the golf ball positioner in place, the golf ball positioner may be accurately and rigidly repositioned during the course of the golfer practicing his or her swing. Furthermore, the sliding swing aid guide assists the golfer during both the take away and follow through of a golf swing and also during putting.

I claim:

1. A golf swing training device for a golfer comprising:

an elongated stance positioning member generally exceeding the length of said golfer's stance for assisting said golfer in positioning the golfer's feet for striking a golf ball, said stance positioning member having a top surface and a base;

a plurality of discrete placement indicators spaced along said top surface of said stance positioning member for indicating the positioning of a golf ball;

said placement indicators having a width generally equal to the width of a golf ball;

a golf ball positioner attachable to said stance positioning member extending generally perpendicularly away from said stance positioning member when positioned at a respective placement indicator position for positioning a golf ball at a prescribed location within the golf stance of said golfer.

2. The device of claim 1 wherein said placement indicators are circular replicating the size and shape of a golf ball.

3. The device of claim 1 including a plurality of discrete attachment locations defined within said top surface of said stance positioning member, said attachment locations being aligned with the center of a respective placement indicator for attaching said golf ball positioner to said stance positioning member aligning said golf ball positioner with respect to a desired placement indicator location.

4. The device of claim 3 wherein said discrete attachment locations are receptacles and said golf ball positioner includes a stem depending downward for being received by a respective of said plurality of receptacles so that said golf ball positioner may easily be located at a first desired location and repositioned at a second desired location by repositioning said stem at a second respective receptacle.

5. The device of claim 1 wherein said golf ball positioner includes an abutment surface near a first end for abutting a front face of said stance positioning member for maintaining said golf ball positioner in a generally perpendicular relationship with said stance positioning member when positioned at a desired location.

6. The device of claim 5 wherein said golf ball positioner includes a locking mechanism for locking said abutment surface against a front face of said stance positioning member for maintaining said golf ball positioner in a generally perpendicular relationship with said stance positioning member when positioned at a desired location.

7. The device of claim 6 wherein said locking mechanism includes a flange for engaging said stance positioning member when said abutment surface abuts said front face of said stance positioning member locking said abutment surface against said front face.

8. The device of claim 1 wherein said golf ball positioner includes a telescoping arm including a first arm and a second arm section telescopically mounted with respect to said first arm providing said golfer with a plurality of positions for placing a golf ball away from the body of said golfer depending on the particular preference of said golfer.

9. The device of claim 1 including a swing guide arm perpendicularly carried at a distal end of said golf ball positioner generally parallel to said stance positioning member having a general length for guiding the swing of said golfer.

10. The device of claim 9 including a swing guide arm carrier carried by said distal end of said golf ball positioner for slidably carrying said swing guide arm providing said golfer with the option of positioning a major portion of said length of said swing aid arm on a first or second side of said golf ball positioner and for assisting said golfer's swing during the take away or during the follow through depending on the golfer's preference.

11. The device of claim 9 wherein said swing guide arm includes a raised first side surface rising a general height above the ground, said first side surface carrying golf swing indicia for guiding the swing of said golfer.

12. The device of claim 9 wherein said swing guide arm includes a ledge for resting on the ground, said ledge carrying mirrored swing indicia enabling the golfer to see their reflection when looking downward from above.

13. The device of claim 9 including a swing guide mount for pivotally mounting said swing guide arm with respect to said golf ball positioner.

14. The device of claim 13 wherein said swing guide mount includes a mounting surface having a ball and said golf ball positioner includes a socket for pivotally receiving said ball.

15. The device of claim 13 wherein said swing guide mount includes a first boss, said golf ball positioner including a first and second boss receptacle disposed on opposite ends of said socket for receiving said boss for locking said swing guide arm in a first or second position thereby maintaining either said first or second swing guide surface facing said golfer.

16. The device of claim 1 wherein said stance positioning member includes a first and second base bar interconnected enabling said stance positioning member to be separated into two separate components for compact storage.

17. A golf swing training device comprising:

an elongated stance positioning member generally exceeding the length of said golfer's stance for assisting said golfer in positioning the golfer's feet for striking a golf ball, said stance positioning member having a top surface and a front and back face;

a plurality of discrete heel placement indicators spaced along said top surface of said stance positioning member near said front face for indicating the positioning of the heels of a golfer;

said heel placement indicators having a width generally equal to the width of a golf ball;

a plurality of discrete attachment locations spaced along said top surface of said stance positioning member near said back face which are aligned with the center of corresponding heel placement indicators; and a golf ball positioner attachable to said stance positioning member at a respective of said discrete attachment locations, said golf ball positioner extending generally perpendicularly away from said stance positioning member when positioned at a heel placement indicator position for positioning a golf ball at a prescribed location within the golf stance of said golfer;

whereby said golfer may align said heels with a desired discrete heel placement indicator relative to said golf ball positioner for properly placing a golf ball within the stance of said golfer.

18. The device of claim 17 including an inclined foot support having a predefined height for said golfer to stand upon, said foot support being carried by said stance positioning member.

19. The device of claim 18 wherein said inclined foot support includes an extension member for traversing said stance positioning member and having an abutment face for abutting the front face of said stance positioning member, said foot support also including a stem depending downward from said extension member for being attached at a respective of said discrete attachment locations.

20. The device of claim 17 including a sway guide attached to said stance positioning member at a respective of said discrete attachment locations.

21. The device of claim 20 wherein said sway guide includes an angular stem for being received within a respective of said discrete attachment locations for angularly carrying said sway guide from said back face of said stance positioning member towards said front face of said stance positioning member for indicating swaying of said golfer.

22. A golf swing training device for a golfer comprising:

an elongated stance positioning member having a top surface and a base extending along a general length for assisting said golfer in positioning the golfer's feet;

a golf ball positioner carried by said stance positioning member extending generally perpendicularly away from said stance positioning member for positioning a golf ball at a desired location within the stance of said golfer, said golf ball positioner having a stem;

a plurality of receptacles defined along said top surface of said stance positioning member for securely receiving said stem of said golf ball positioner at selected discrete locations;

said receptacles maintaining said golf ball positioner at said selected locations even if struck by a golf club swung by said golfer; and a locking mechanism for locking said golf ball positioner in place when positioned at a desired location.

23. The device of claim 22 wherein said locking mechanism positioner includes an abutment surface near a first end for abutting a front face of said stance positioning member for maintaining said golf ball positioner in a generally perpendicular relationship with said stance positioning member when positioned at a desired location.

24. The device of claim 23 wherein said locking mechanism includes a flange for engaging said base when said abutment surface abuts said front face of said stance positioning member locking said abutment surface against said front face.

25. A golf swing training aid comprising:

an elongated stance positioning member generally exceeding the length of said golfer's stance for assisting said golfer in positioning the golfer's feet for striking a golf ball, said stance positioning member having a top surface and a front and back face;

a golf ball positioner attachable to said stance positioning member, said golf ball positioner having a stance positioning end and a distal end, said golf ball positioner extending generally perpendicularly away from said stance positioning member when attached to said stance positioning member;

a swing guide arm slidably mounted perpendicularly with said distal end of said golf ball positioner generally parallel to said stance positioning member, said swing guide arm providing said golfer with the option of positioning a major portion of said length of said swing aid arm on a first or second side of said golf ball positioner and for assisting said golfer's swing during the take away or during the follow through depending on the golfer's preference; and said swing guide arm including mirrored swing indicia enabling the golfer to see their reflection when looking downward from above.

26. The device of claim 25 including a swing guide mount for pivotally mounting said swing guide arm with respect to said golf ball positioner.

27. The device of claim 26 wherein said swing guide mount includes a mounting surface having a ball and said golf ball positioner includes a socket for pivotally receiving said ball.

28. The device of claim 27 wherein said swing guide mount includes a first boss, said golf ball positioner including a first and second boss receptacle disposed on opposite ends of said socket for receiving said boss for locking said swing guide arm in a first or second position thereby maintaining either said first or second swing guide surface facing said golfer.

* * * * *